United States Patent [19]

Caplis et al.

[11] 4,335,872

[45] Jun. 22, 1982

[54] SAMPLE PREPARATION SUPPORT APPARATUS

[76] Inventors: Michael E. Caplis, 676 N. 50 West; Larry S. Eichmeier, 210 Coolwood Dr., both of Valparaiso, Ind. 46383

[21] Appl. No.: 129,114

[22] Filed: Mar. 10, 1980

[51] Int. Cl.[3] ..... B25B 1/20

[52] U.S. Cl. ..... 269/43; 269/219; 269/306; 269/15; 211/4; 211/60 R

[58] Field of Search ..... 269/43, 88, 219, 296, 269/306, 15; 73/61.1 C; 210/198 C; 422/70; D24/31, 32; 211/60 R, 60 G, 60 M, 68, 128, 64, 65, 4, 8

[56] References Cited

U.S. PATENT DOCUMENTS

| | | | |
|---|---|---|---|
| D. 168,277 | 11/1952 | Roberts | D24/32 X |
| D. 185,600 | 6/1959 | Gaither | 211/64 X |
| 1,914,276 | 6/1933 | Moore | 211/4 |
| 2,623,639 | 12/1952 | Levy | 211/64 |
| 2,783,896 | 3/1957 | Agostini et al. | 211/64 |
| 2,935,908 | 5/1960 | Phillips | 210/198 C |
| 2,958,422 | 11/1960 | Calolero et al. | 211/64 X |
| 3,535,086 | 10/1970 | Baitsholts | 210/198 C |
| 3,618,785 | 11/1971 | Newman | 211/64 |
| 3,757,952 | 9/1973 | Baitsholts | 210/198 C |
| 4,037,831 | 7/1977 | Johnson | 269/306 |
| 4,113,107 | 9/1978 | Jaeger | 211/64 |

*Primary Examiner*—Robert C. Watson
*Attorney, Agent, or Firm*—Walter Leuca

[57] ABSTRACT

This invention is an apparatus for supporting a plurality of sample preparation cartridge units to expedite the handling of sample preparation. The apparatus comprises a pair of plates in space parallel relation. The first plate is mounted on end posts and the second plate is supported over the first plate by apparatus which adjustably raise and lower the second plate. The first and second plates are provided with notches along the longitudinal sides of the plates which are in vertical alignment. An elongated bar is hingedly connected between the plates and provided with apparatus to lock along the longitudinal side of the plates. The sample preparation cartridges which generally comprise a cylindrical body and cylindrical stems concentrically extending from the cartridge body, are placed between the plates so that the stems enter vertically aligned notches. The elongated bars are moved to laterally abutt against the cylindrical bodies of the cartridges and locked into place so that the cartridges are fixed vertically between the plates and laterally between the notches and the bars. A plurality of cartridges may thus be supported during the column separation stage.

6 Claims, 5 Drawing Figures

SAMPLE PREPARATION SUPPORT APPARATUS

BACKGROUND OF THE INVENTION

1. Field of the Invention

This invention relates generally to support apparatus and more particularly to a support apparatus adapted to positionally fix a multiplicity of sample preparation cartridge units.

2. Description of the Prior Art

In the art of sample preparation wherein it is desired to analyze one or more compounds by removing interferences from a complex sample matrix, prior art procedures utilize Sep-Pak (TM) cartridges or the like which are small, self-contained cartridges packed with liquid chromatographic separating materials optimized for sample preparation. These cartridges are designed to retain and separate specific classes and groups of compounds while allowing other materials to pass through and make sample preparation faster, easier and more efficient. The prior art method for handling or managing these cartridges is to hold them individually by clamp or vise contrivances during the column separation stage. Since the cartridges are densely packed with a resin material, the pumping force necessary to pass the liquid through the cartridge is considerable necessitating a secure support. Such prior art support lacked uniform method and means and were cumbersome and time consuming.

SUMMARY OF THE INVENTION

Accordingly, this invention provides a support apparatus for securely fixing a multiplicity of Sep-Pak (TM) cartridges or the like and enables easy and rapid management of these cartridges during the column separation stage. This is accomplished by providing a horizontal stand having spaced parallel plates whose sides are notched for receiving the cartridges which are supported therein in saddle like fashion. Bars are hinged and pivotally connected to the plates and movable between the plate sides to bear against the cartridge bodies to securely fix the cartridges in a saddle hold. The notched plates are provided with means for adjusting the space therebetween and the hold bars are rectangular in cross section to provide an interchangeable or convertable height and depth by mearly axially rotating the bars to accommodate to the space between the plates which are adjusted for different size cartridges.

Other objects and advantages will become apparent after a study of the following specifications read with reference to the accompanying drawings wherein is illustrated a preferred embodiment of this invention.

DESCRIPTION OF THE PREFERRED EMBODIMENT

Figure 1:
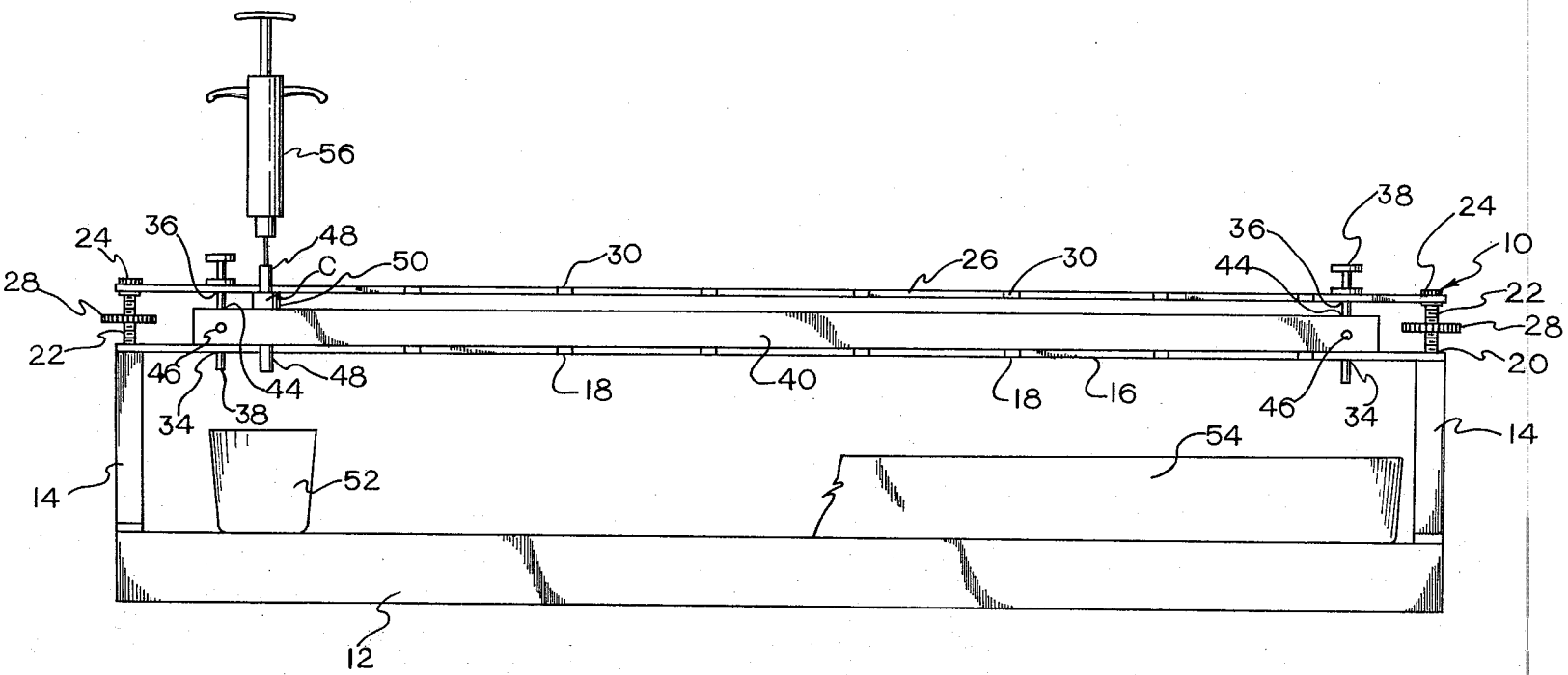
FIG. 1 is a side elevation of the support apparatus of our invention.

Referring now more particularly to the drawings, numeral 10 designates generally a preferred embodiment of this invention. It comprises a generally rectangular base 12 provided with upstanding posts 14, preferably adjacent each corner of the base. A first plate member 16 is supported on the top of posts 14. A plurality of notches 18 are formed in the longitudinal edge or side of plate member 16, regularly spaced and along the length thereof. Plate member 16 is formed with threaded holes 20 in each corner thereof which continue into the end of upstanding posts 14 to which plate member 16 is fixed by any convenient means. Each of the threaded holes 20, threadedly receive a threaded dowel shaft 22. The other end of each dowel shaft 22 is provided with a circumferentially grooved cap 24 formed to axially lock onto a second plate member 26 while allowing rotational movement relative to plate member 26. Knurled collar 28 is keyed onto each dowel shaft 22 to facilitate manual rotation of each dowel shaft 22.

Figure 5:
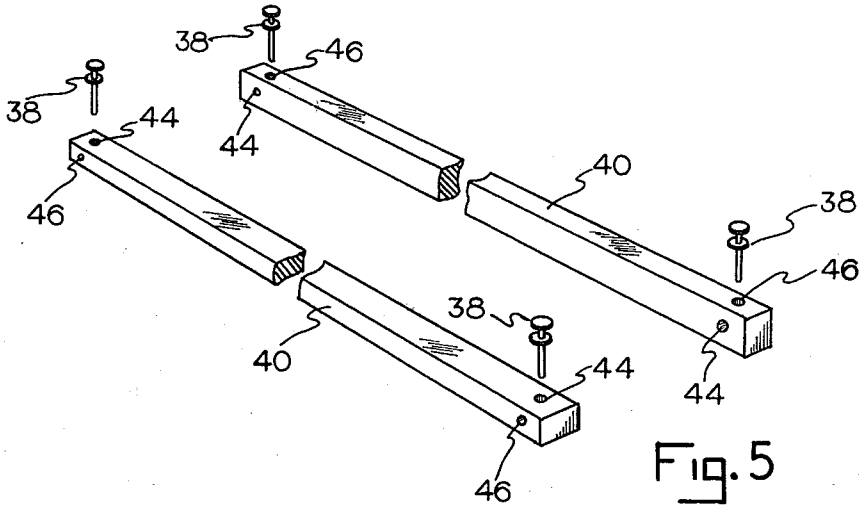
FIG. 5 shows two perspective views of a cartridge lock bar in fragment, shown axially rotated 90° illustrating the use of a single rectangular bar to accommodate two different space dimensions between the plates.
Figure 3:
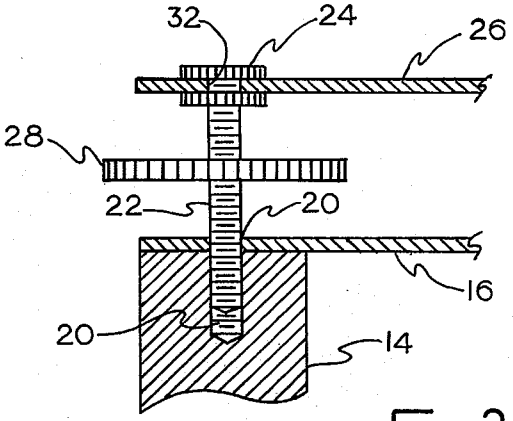
FIG. 3 is a detailed section of the adjusting screw means supporting the top plate.

Second plate member 26 is similar in shape and size to first plate member 16, and is similarly formed with notches 30 along the longitudinal sides thereof, and is positioned to overlay first plate member 16 and supported thereover in the grooves of caps 24 fixed to the ends of dowel shafts 22. Accordingly, second plate member 26 is provided with holes 32 at each corner thereof aligned to be assembled to caps 24 at the ends of dowel shafts 22. Notches 30 on plate member 26 are vertically aligned with notches 18 in plate member 16. First and second plate members 16 and 26 respectively are further provided with holes 34, 36, respectively, each adjacently spaced from each corner for receiving a hinge pin 38 therethrough. Elongated lock bars 40 and 42 are provided with holes 44 and 46 laterally therethrough disposed at 90° respectively, in the ends thereof. Bars 40 and 42 are positioned between first and second plate members 16 and 26 along the longitudinal sides thereof and are secured to plates 16 and 26 by means of hinge pins 38 at both ends of the bars so that the bars may be made to pivot at either end. Second plate member 26 is adjustably raised and lowered by manually rotating collar 28 of each dowel shaft 22. FIG. 3 illustrates in detail the method and means above described that the second plate member 26 may be adjustably spaced from first plate member 16. For purposes of accommodating different size cartridges, elongated bars 40 and 42 may be axially rotated 90° and reassembled, to plate members 16 and 26. As illustrated in FIG. 5, bars 40 and 42 are rectangular in cross section, having a thickness and depth of different dimensions to fit between plate members 16 and 26 as they are adjustably raised and lowered to accommodate different size cartridges, the same bars 40 and 42 may be used for cartridges of two different sizes. If the adjustment required is extensive, like elongated bars of different thickness and depth sizes may be provided to replace bars 40 and 42 and thereby accommodate the new set of cartridges as required.

Figure 2:
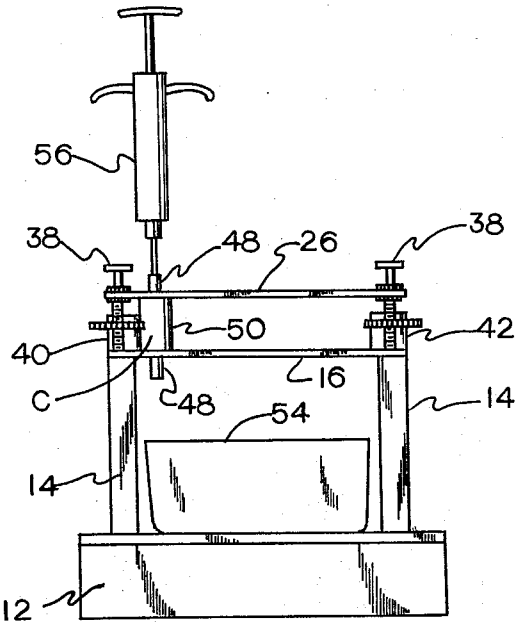
FIG. 2 is an end elevation thereof.
Figure 4:
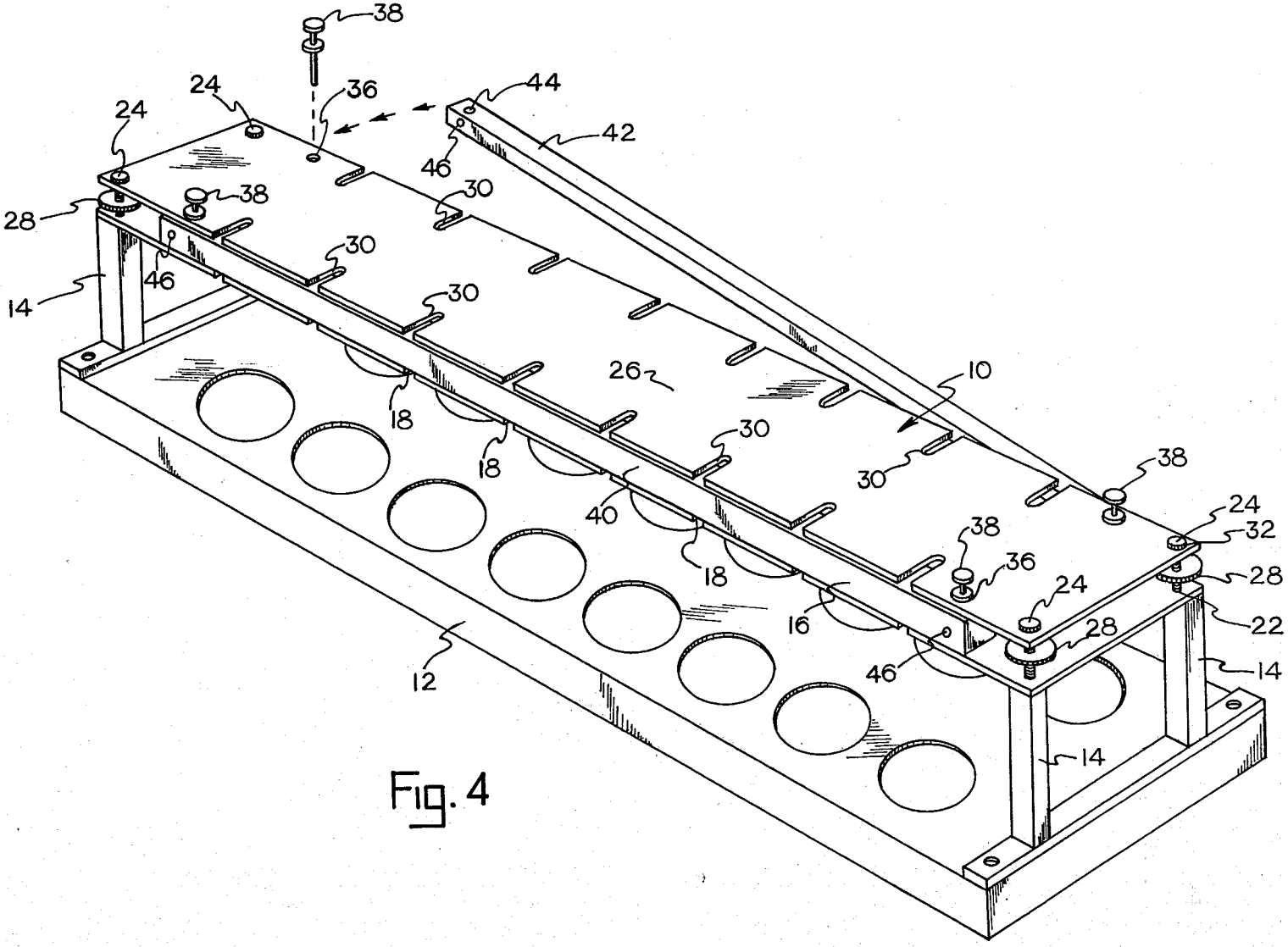
FIG. 4 is a perspective view of the support apparatus of this invention showing the operation of the pivotable cartridge lock bars.

In the operation of this invention threaded dowel shafts 22 provided at each corner of the support apparatus 10 are adjusted to position second plate member 26 at the proper vertical space relative to first plate member 16 so that notches 30 and 18, respectively, provided in the sides thereof, receive the end stems 48 of sample cartridge "C". Bars 40 and 42 are longitudinally positioned between plate members 16 and 26 to bear against body 50 of cartridge "C" thereby locking the cartridges saddle fashion between the confines of notches 18 and 30 and the infacing side of bars 40 and 42. Bars 40 and 42 are locked into position by inserting hinge pins 38 in holes 34 and 36 formed in plate members 16 and 26 respectively. With cartridge "C" thus securely fixed and the appropriate container whether a beaker 52 (FIG. 1) or a waste pan 54 (FIG. 2) is placed on base 12 positioned below the cartridges, the liquid material to be analyzed is pumped through the cartridge to chromatographically separate its constituent compounds. In FIGS. 1 and 2, I have illustrated the pump as a syringe 56, however, a motorized pump (not shown) may be used for passing the liquid material through the cartridge. It will be obvious to those skilled in the art to which this invention pertains that providing support apparatus 10 of our invention enables expeditious handling of a plurality of sample preparation cartridges.

We claim:

1. A sample preparation support apparatus comprising:

upright end members;

a first plate member supported on said upright end members, said first plate member having a plurality of spaced notches formed along the side thereof;

a second plate member having a plurality of spaced notches formed along the side thereof;

means supporting said second plate member vertically spaced over said first plate member, said notches in said first and second plate members being in vertical alignment; and an elongated bar member removeably connected between said first and second plate members, said elongated bar member being contiguous to said first and second plate members.

2. A sample preparation support apparatus comprising:

upright end members;

a first plate member supported on said upright end members, said first plate member having a plurality of space notches formed along the side thereof;

a second plate member having a plurality of spaced notches formed along the side thereof;

means supporting said second plate member vertically spaced over said first plate member, said means being adjustable for varying the vertical space of said second plate member over said first plate member, said notches in said first and second plate members being in vertical alignment; and an elongated bar member provided between said first and second plate members contiguous to said plate members.

3. A sample preparation support apparatus comprising:

upright end members;

a first plate member connected to said upright end members;

a support means extending from said first plate member;

a second plate member connected to said support means extending from said first plate member, said support means supporting said second plate member vertically spaced from said first plate member;

said first plate member having a plurality of spaced notches formed along the side thereof, said second plate member having a plurality of spaced notches formed along the side thereof, said notches in said first plate member being vertically aligned with said notches in said second plate member; and an elongated bar member between said first and said second plate members said bar member being contiguous to said second and first plate members.

4. A sample preparation support apparatus comprising:

upright end members;

a first plate member connected to said upright end members;

a support means extending from said first plate member;

a second plate member connected to said support means extending from said first plate member, said support means supporting said second plate member vertically spaced from said plate member being adjustable for varying the vertical space of said second plate member over said first plate member;

said first plate member having a plurality of spaced notches formed along the side thereof, said second plate member having a plurality of spaced notches formed along the side thereof, said notches in said first plate member being vertically aligned with said notches in said second plate member; and an elongated bar member between said first and said second plate member and contiguous to said members.

5. A sample preparation support apparatus comprising:

upright end members;

a first plate member supported on said upright end members, said first plate member having a plurality of spaced notches formed along the side thereof;

a second plate member having a plurality of spaced notches formed along the side thereof;

means supporting said second plate member vertically spaced over said first plate member, said notches in said first and second plate members being in vertical alignment; and an elongated bar member provided between said first and second plate members, said bar member being contiguous the length thereof to said first and second plate members.

6. A sample preparation support apparatus comprising:

upright end members;

a first plate member connected to said upright end members;

a support means extending from said first plate member;

a second plate member connected to said support means extending from said first plate member, said support means supporing said second plate member vertically spaced from said first plate member;

said first plate member having a plurality of spaced notches formed along the side thereof, said second plate member having a plurality of spaced notches formed along the side thereof, said notches in said first plate member being vertically aligned with said notches in said second plate member; and an elongated bar member contiguously fitted between said first and said second plate members.

* * * * *